US010685792B2

(12) United States Patent
Supriya et al.

(10) Patent No.: US 10,685,792 B2
(45) Date of Patent: Jun. 16, 2020

(54) SYSTEM AND METHOD FOR THERMAL PROTECTION OF AUTOMATIC TRANSFER SWITCH

(71) Applicant: Cummins Power Generation IP, Inc., Minneapolis, MN (US)

(72) Inventors: Amrit Supriya, Minneapolis, MN (US); Wangwei Zhou, Shoreview, MN (US)

(73) Assignee: Cummins Power Generation IP, Inc., Minneapolis, MN (US)

( * ) Notice: Subject to any disclaimer, the term of this patent is extended or adjusted under 35 U.S.C. 154(b) by 1 day.

(21) Appl. No.: 16/100,935

(22) Filed: Aug. 10, 2018

(65) Prior Publication Data

US 2019/0051469 A1 Feb. 14, 2019

Related U.S. Application Data

(60) Provisional application No. 62/544,498, filed on Aug. 11, 2017.

(51) Int. Cl.

| | |
|---|---|
| ***H01H 9/00*** | (2006.01) |
| ***H01H 9/34*** | (2006.01) |
| *H01H 9/52* | (2006.01) |
| *H01H 9/40* | (2006.01) |

(52) U.S. Cl.

CPC ..... *H01H 9/0072* (2013.01); *H01H 9/34* (2013.01); *H01H 9/40* (2013.01); *H01H 9/52* (2013.01); *H01H 2300/018* (2013.01)

(58) Field of Classification Search

CPC .. H01H 9/0072; H01H 9/34; H01H 2300/018; H01H 9/00

See application file for complete search history.

(56) References Cited

U.S. PATENT DOCUMENTS

| | | | | |
|---|---|---|---|---|
| 6,111,745 | A * | 8/2000 | Wilkie, II | H02B 1/21 174/535 |
| 6,700,087 | B2 | 3/2004 | Rademacher et al. | |
| 6,919,518 | B2 | 7/2005 | Rademacher et al. | |
| 2003/0155330 | A1 * | 8/2003 | Rademacher | H01H 9/0072 218/22 |

* cited by examiner

*Primary Examiner* — Robert L Deberadinis
(74) *Attorney, Agent, or Firm* — Foley & Lardner LLP

(57) ABSTRACT

An automatic transfer switch assembly includes a first phase switch component, a second phase switch component and a third phase switch component arranged in order of the first phase switch component, the second phase switch component, and the third phase switch component in a line. The assembly further includes a first shield disposed between the first phase switch component and the second phase switch component, and a second shield disposed between the second phase switch component and the third phase switch component. Each of the first shield and the second shield includes a plurality of laminations of electrical steel.

24 Claims, 3 Drawing Sheets

SYSTEM AND METHOD FOR THERMAL PROTECTION OF AUTOMATIC TRANSFER SWITCH

CROSS-REFERENCE TO RELATED APPLICATION

This application claims the benefit of and priority to U.S. Application No. 62/544,498, filed Aug. 11, 2017, which is hereby incorporated by reference in its entirety.

FIELD

The present invention relates generally to the field of automatic transfer switches (ATSs).

BACKGROUND

Many types of ATSs include phase switch components that are mounted side-by-side proximate to each other, generally along a linear path. For example, a typical arrangement includes a Phase A switch component, a Phase B switch component and a Phase C switch component arranged in a line in that order.

SUMMARY

One embodiment relates to an automatic transfer switch assembly including a first phase switch component, a second phase switch component and a third phase switch component arranged in order of the first phase switch component, the second phase switch component, and the third phase switch component in a line. The assembly further includes a first shield disposed between the first phase switch component and the second phase switch component, and a second shield disposed between the second phase switch component and the third phase switch component. Each of the first shield and the second shield includes a plurality of laminations of electrical steel.

Another embodiment relates to an automatic transfer switch including a first phase switch comprising a first plurality of cassettes, a second phase switch comprising a second plurality of cassettes; and a third phase switch comprising a third plurality of cassettes. The automatic transfer switch further includes a plurality of separators separating respective cassettes of the pluralities of cassettes, and at least one separator of the plurality of separators comprises an air flow path permitting air flow between two neighboring cassettes.

A further embodiment relates to a separator assembly comprising at least one separator having a planar portion having at least one notch portion on a surface thereof; a plurality of adjacent apertures; and two extensions projecting from opposed sides of the planar portion, wherein each of the extensions has a first terminal portion projecting outwardly from the planar portion, and a second terminal portion opposed to the first terminal portion, the second terminal portion being coextensive with at least a portion of the at least one notch portion, and wherein the notch is centered between the extension portions.

An additional embodiment relates to a method comprising disposing a first phase switch component, a second phase switch component and a third phase switch component in order of the first phase switch component, the second phase switch component, and the third phase switch component in a linear arrangement, spacing the first phase switch component and the second phase switch component apart by placing a first shield between the first phase switch component and the second phase switch component, spacing the second phase switch component and the third phase switch component apart by placing a second shield between the second phase switch component and the third phase switch component, and disposing a first actuator between the first phase switch component and the second phase switch component and a second actuator between the second phase switch component and the third phase switch component.

Additional features, advantages, and embodiments of the present disclosure may be set forth from consideration of the following detailed description, figures, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE FIGURES

The accompanying figures, which are included to provide further understanding of the invention, are incorporated in and constitute a part of this specification, illustrate the advantageous results produced by embodiments of the present disclosure and, together with the detailed description, serve to explain the principles of the present disclosure. No attempt is made to show details of the present disclosure to a greater extent than may be necessary for a fundamental understanding of the present disclosure and the various ways in which it may be practiced.

DETAILED DESCRIPTION

Figure 1:
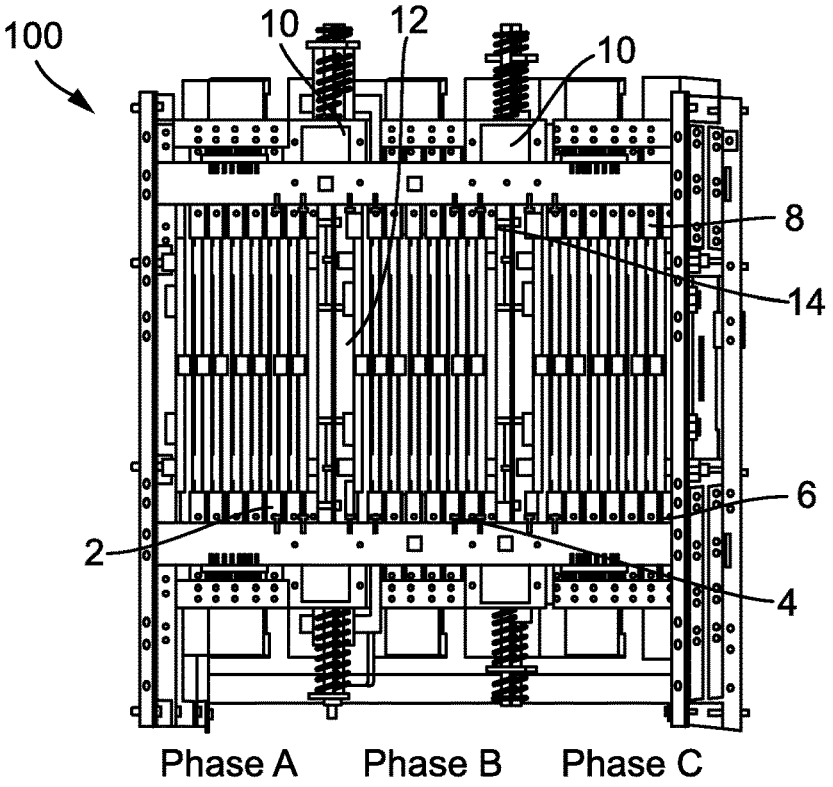
FIG. 1 illustrates an ATS system according to an embodiment.

In the following detailed description, reference is made to the accompanying figures, which form a part hereof. In the figures, similar symbols typically identify similar elements, unless context dictates otherwise. The illustrative embodiments described in the detailed description, figures, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be performed, arranged, substituted, combined, and designed in a wide variety of different configurations, all of which are explicitly contemplated and made part of this disclosure.

An ATS is used to switch an electric load back and forth between two or more power sources, for example, a primary power source, such as a utility, and a secondary power source, such as a generator. Transferring power from the primary to the secondary source happens, for example, when the utility experiences a blackout. When the power outage is over, the ATS switches the power source back to utility power.

In at least one ATS, a steel plate is placed in between phases or between cassettes. The steel plate provides an electromagnetic shield to prevent interference in between the phases or the cassettes. When a fault current passes through different phases, the electromagnetic force is large enough to push a contact of the ATS open onto a neighboring contact. In this manner, the fault current affecting phase A, for example, will actually affect the force balance on phase B. The interference can be reduced by expanding the phase to phase distance, however, increasing the distance in between phases has the effect of expanding the switch width, and also increasing all mechanical stresses on the ATS shaft which drives the cassettes to open or close. Positioning the steel plate in between phases may introduce other issues, such as eddy currents in the steel (or in another conductive separator) that result in parasitic losses and increases in heat in the ATS. Such heat increases may be substantial, e.g., up to 10° C., for example.

In ATSs having steel plates as described above, the heat rise and parasitic losses may substantially degrade performance and reliability. Such systems may further include other components in order to reject heat to the environment. Further, such systems may be unable to comply with industrial safety standards and requirements (e.g., UL standards) and may result in de-rating of the ATS.

Further, certain ATS systems may be de-rated due to poor thermal performance. Poor thermal performance may be due to conductor effects as current is being carried to support heavy loads. The desire for ATS systems to comply with various regulatory standards can impose a limit on how many parallel contact "cassettes" (or other parallel contact arrangements, such as circuit breakers) can be added. Adding contacts can also impact thermal performance because each contact added takes away from the ability of the system to perform cooling, and may decrease reliability. In other words, adding additional contacts or cassettes is often a case of diminishing returns, as each additional set of contacts or cassette increases thermal heating mass while diminishing air flow and increasing mechanical complexity and required switching force. Further, having additional contacts can increase unit costs owing to additional parts and may require more robust actuator mechanisms.

Embodiments of the present disclosure provide devices and methods for thermal protection of ATSs. Such embodiments allow for mitigation of various phenomena such as losses and interference from electromagnetic cross coupling. Such embodiments also allow for reduction of losses due to induced eddy currents.

Figure 2:
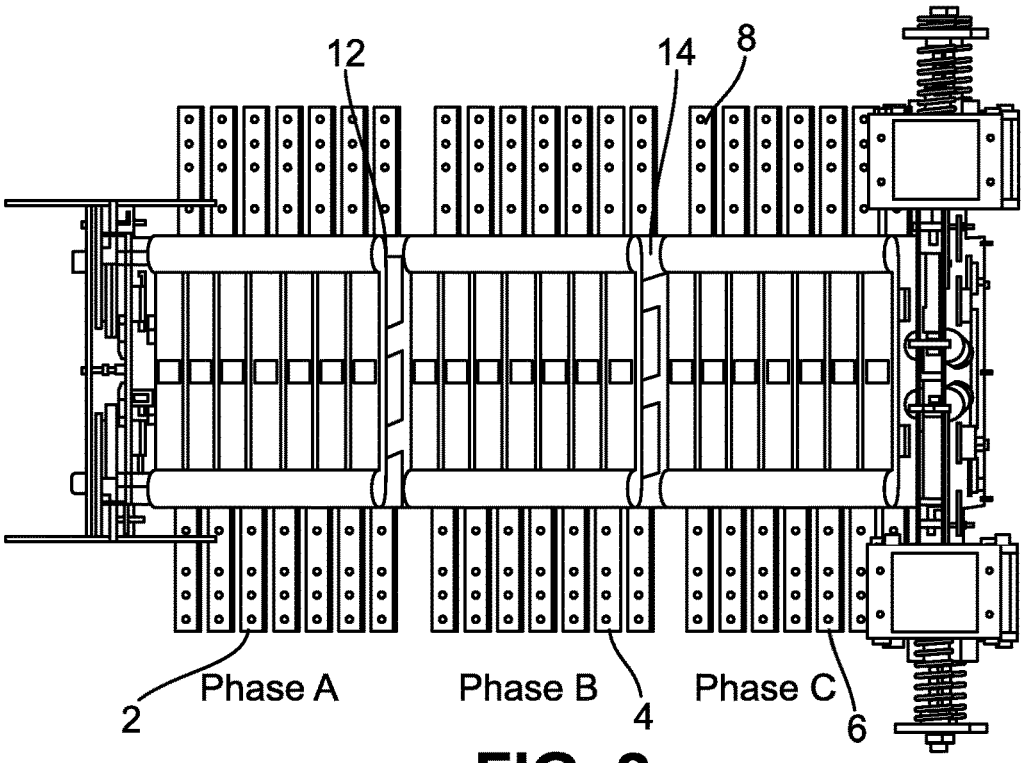
FIG. 2 illustrates an ATS system according to an embodiment.

Referring now to FIG. 1, an ATS system according to an embodiment is depicted. The ATS system includes an ATS 100 that is a three phase ATS including a phase A switch 2, a phase B switch 4 and a phase C switch 6 arranged in a line in order of phase A, phase B and phase C. Interposed between the phase A switch 2 and the phase B switch 4 is an actuator 10. Another actuator 10 can be optionally interposed between the phase B switch 4 and the phase C switch 6. It is also noted that in some embodiments, actuators 10 are omitted from between the phase A switch 2, phase B switch 4, and phase C switch 6 and are coupled externally to the phase switches 2, 4, 6, as shown in FIG. 2. Actuators can include, but are not limited to, solenoids, permanent magnet actuators, stepper motors, or electrical motors that are either directly coupled to or indirectly coupled through lever arms and linkage to actuator shafts that move the contacts of the cassettes of the ATS and select the source to couple to the electrical load. Placement of actuator(s) 10 internal to the ATS switch 100 shortens the shaft distance for the actuator shaft(s) from the actuator(s) 10 to the contact cassettes and has the effect of dividing the applied torque on either side of the actuator(s) 10 so that the torque requirement is smaller on each side of the actuator(s) 10. In this manner, each actuator shaft can be made smaller, with less twisting or flexing, for more accurate actuation during switch opening and closure, and carries less stress.

Referring still to FIG. 1, each of the phase A switch 2, the phase B switch 4 and the phase C switch 6 includes a cassette subsystem made of contact cassettes. As shown in FIG. 1, each cassette subsystem contains a plurality of cassettes 8 with a single set of contacts, which are arranged as discussed in more detail below. Each of the cassettes of a single phase (phase A, B, or C) is generally coupled together in parallel to form the switch and to handle the required current for the load.

Furthermore, between at least some of the phases, shielding members are provided. For example, as shown in FIG. 1, a first shielding member 12 is disposed between the phase A switch 2 and the phase B switch 4. A second shielding member 14 is disposed between the phase B switch 4 and the phase C switch 6. The first or second shielding members 12, 14 may be laminated side plates, as discussed in more detail below. In some embodiments, the shielding members 12, 14, and actuators 10 disposed between the phases A, B and C may be spaced so as to reduce interference between phases. For example, the shielding member 12 and its associated actuator 10 may be disposed between phase A switch 2 and phase B switch 4 so as to reduce electromagnetic flux density effects by increasing the distance between the phase A switch 2 and the phase B switch 4. The electromagnetic flux density generated by phase A, for example, will drop by a value that is a reciprocal ratio to the distance between phase A and phase B. It is noted that shielding members 12, 14 can be either single (placed on only one side of the actuator 10 or intervening space between the phases) or double (placed on both sides or forming the walls of the actuator 10 or intervening space between the phases). In other words, there may be a single shielding member provided per actuator 10 between each phase, or dual plates with one plate on each side of actuator 10.

Further, the shielding members 12, 14 may either be independent of the actuator(s) 10 or form part of the structural wall (i.e., a case wall) of the actuator(s) 10 and provide support for the actuator shafts that actuate the contact cassette members. In at least one embodiment, a single actuator case may be provided with a shielding member 12, 14, with the shielding member replacing a second case component. Such a configuration may be provided with single or dual plating of the actuator 10, and may increase air flow (cooling air flow) to the core of the ATS 100 (the switch core). In particular, increasing the distance spacing between the phases has the further effect of increasing cooling airflow to the core of the ATS 100, even if the space is partially filled with actuators 10, so as to cool the contact cassettes of the phases 2, 4, 6, and further increase the rated current capacity.

In some embodiments, the reduction of electromagnetic flux density effects may also be controlled by altering electromagnetic permeability and selecting materials having a particular flux density and determining a quantity of shielding members and/or actuators and their locations (i.e., a spacing arrangement). For example, the flux density is affected by the saturation levels of the material used. Electric steel, for example, may have a saturation level of 1.5 Tesla, while various low carbon steels may have saturation levels, e.g., lower than 1 Tesla. In some embodiments, each shielding member is made of low carbon steel having a low saturation (e.g., lower than 1 Tesla, and between 0.1-1 Tesla, for example). In some embodiments, a high saturation material may be used, for example, a magnetic conducting material such as nickel (Ni).

Further, the electromagnetic properties of the shielding members 12, 14 themselves are also affected by the thickness of the shielding members. In some embodiments multiple laminations may be used to construct shielding members 12, 14 to reduce eddy current flow and resulting losses. In some embodiments, a single thick shielding member may be used; however, the single thick shielding member may have a substantial eddy effect and contribute to temperature rises of 150. In some embodiments, the thickness of the shielding member is between 0.2 mm to 0.5 mm. Some embodiments may include shielding members that are less than 0.2 mm in thickness; however, thinner shielding members are generally more expensive.

Each of the first shielding member 12 and the second shielding member 14 comprises laminations of electrical steel, according to an embodiment. The laminations may be formed of steel having various carbon contents, e.g., 1-5% carbon, 5-10% carbon, 1-12% carbon, or 10-12% carbon, for example. In some embodiments, the laminations are formed of pure iron (Fe) or alloys with silicon (Si). The lower carbon steel is generally relatively inexpensive; however, power losses are comparatively high. Steel with silicon (e.g., iron-silicon steel) may have comparatively lower power losses but may have reduced shielding properties.

Further, the individual layers of laminated steel of shielding members 12, 14 may be joined together in a variety of ways. For example, a stacked arrangement of the laminations may be obtained by a mechanical connection. In some embodiments, the laminations are riveted together using one or more rivets. In some embodiments, the laminations may be joined together by spot welding. Further, each lamination may be insulated. For example, a layer of insulating film may be applied to at least one exterior surface of the assembly of the individual lamination sheets which are stacked together. In some embodiments, the insulating film may be applied to one or more individual sheets of the stacked lamination assembly, on one or more surfaces thereof. In some embodiments, insulating paint may be used instead of or in addition to insulating film.

As shown in FIG. 2, the first shielding member 12 and the second shielding member 14 may be parallel to each other. A width of shielding members 12, 14 may be less than a width of each cassette 8. Alternatively, the shielding members 12, 14 may be substantially equivalent in width to the cassettes 8.

The first shielding member 12 and the second shielding member 14 allow for various technical benefits to be realized. The laminated electrical steel of which the shielding members 12, 14 are formed has enhanced magnetic resistance. Accordingly, owing to the higher magnetic resistance, parasitic power losses from cross-coupling of the switches is lowered. Further, induced noise may also be reduced. In some embodiments, the induced heat rise of one or more terminal lugs on the ATS 100 may be about 50° C. (51° C. for example), and the induced heat rise for each shielding member 12, 14 is up to 70° C. Further, in at least one embodiment, an ATS 100 including sixteen shielding members 12, 14 made of low carbon thin steel. Experiments on such embodiments confirmed that the ATS 100 experienced a temperature reduction from 170° C. to 70° C. as compared to an ATS in which only one shielding member was provided.

Figure 4:
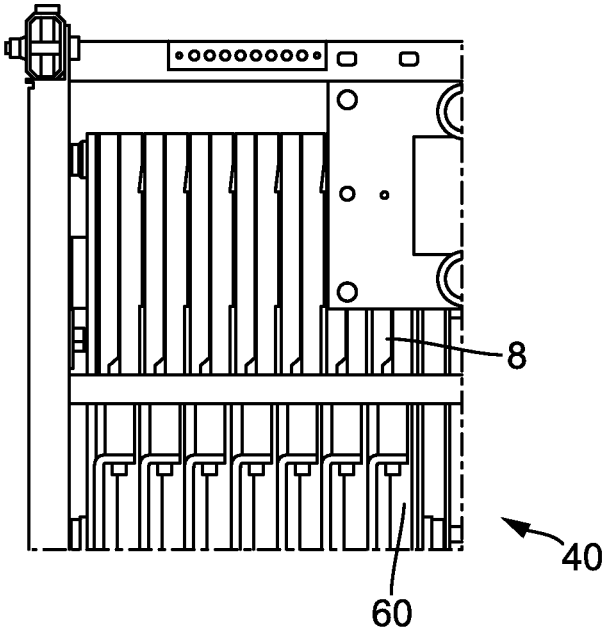
FIG. 4 illustrates a cassette subsystem according to an embodiment.

As shown in FIG. 4, one or more separators 60 may be arranged between the cassettes 8 of a portion of a cassette subsystem 40. The cassette subsystem 40 may be provided in each of the phases 2, 4 and 6 discussed above and shown in FIGS. 1 and 2. By providing a separator 60 between one or more neighboring cassettes 8, air flow may be improved through the cassette subsystem 40, enhancing the effectiveness of cooling and contributing to a smaller induced part heat rise. In particular, the separator 60 contributes to more effective cooling, and lowers the overall temperature of terminals of the ATS 100 by several degrees, e.g., by 1-4° C. In some embodiments, the ATS has a sustained reduction in temperature by at least 4° C. for an extended period of time while in continuous operation (e.g., for a day or more).

As indicated above, exemplary implementations include internal actuators, where each actuator has either a single or double wall of a shielding member 12, 14 made of a laminated steel plate. The single shielding member 12, 14 may be provided per actuator between each phase, or dual plates may be used with one plate on each side of the actuator, as mentioned above. Other implementations include external actuators, where a single shielding member 12, 14 is positioned so as to replace a wall of the actuator case, with single or dual plating of the actuator 10 itself. Such implementations have increased air flow of gapped separator plates, where there are spaces (gaps) that are internally placed (between shielding members 12, 14) or external (between one or both shielding members 12, 14 and adjacent cassettes). Where internal actuators are provided, a shortened torque arm on the shaft of actuator may be employed, thus permitting a smaller shaft and smaller bearings to be used. Further, by increasing the spacing or distance between adjacent phases, as described above, the electromagnetic field between them can controlled to reduce interference and losses (as the EM field decreases at a rate proportional to the square of distance). In addition, there is increased electromagnetic shielding due to the electrical steel laminations that the shields are made from. Furthermore, by employing separators 60, there is a reduced skin effect on the current flow, so current flows more evenly across all the contact cassettes in a phase. In particular, current flowing in closely spaced parallel conductors generally forces current out to the conductors at ends of the assembly. Accordingly, including separators increases the relevant distances, as well as increases air flow, and thus reduces this skin effect.

Referring again to FIG. 4, the cassettes 8 may be arranged so as to be substantially co-planar with each other. That is, the cassettes 8 may share a common plane, such that a line may be drawn between at least a point on one of the cassettes 8 and another of the cassettes 8. In other words, the cassettes 8 may be aligned so as to lie substantially in the same plane. Additionally, the cassettes 8 may be structured such that each cassette 8 is substantially rectilinear. For example, as shown in FIGS. 1 and 2, the cassettes 8 have a profile that is characterized by straight lines. Thus, the cassettes 8 may be structures defined by straight lines or formed with straight lines. Further, the cassettes 8 may have edges, surfaces, and/or faces that meet at right angles, so as to be substantially rectangular.

Figure 3:
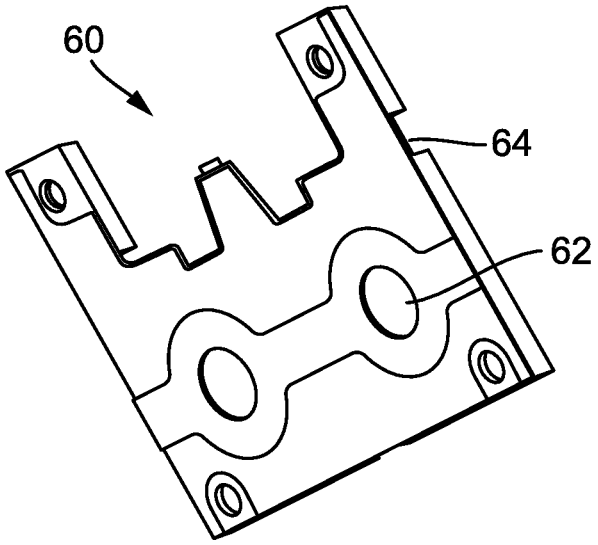
FIG. 3 illustrates a separator of an ATS system according to an embodiment.

Referring now to FIG. 3, separator 60 is shown. The separator 60 may be provided between cassettes 8 as described above. The separator 60 has a planar portion in which apertures 62 and grooves or notches 64 are formed. The separator 60 is structured so as to permit air flow in a groove or notch formed on a side of the separator 60. That is, air may flow through the groove or notch so as to provide for a cooling effect. The groove 64 may be formed as substantially rectilinear feature defined by straight lines, formed with straight lines or having a substantially linear profile, for example. The groove 64 may have a variety of other configurations. The separator 60 may be formed of thermosetting polymer (e.g., bulk molding compound (BMC), sheet molding compound (SMC), or dough molding compound (DMC)). Alternatively, separator 60 may be made of polycarbonate. In at least one embodiment, the separator 60 may be formed of the aforementioned materials via additive manufacturing.

Figure 5:
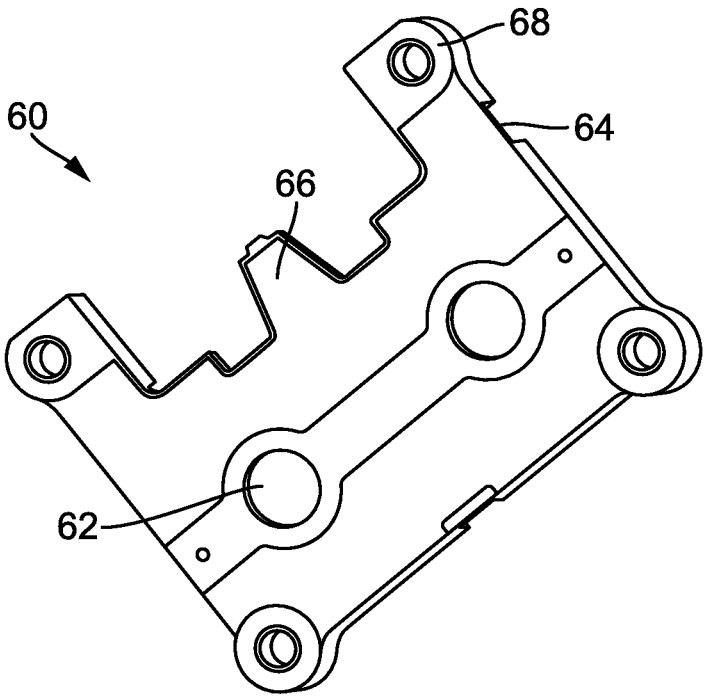
FIG. 5 illustrates another separator according to an embodiment.

Referring now to FIG. 5, a modified separator 60 is shown. The separator 60 may be provided between cassettes 8, as with the separator shown in FIG. 3. Unlike the separator 60 shown in FIG. 3, the separator 60 shown in FIG. 5 includes extending portions 68 having at least one round surface, whereas the extending portions of separator 60 of FIG. 3 have flat surfaces. In particular, two extending portions 68 of the separator 60 shown in FIG. 5, on a first side from apertures 62) have convex portions in the form of round edges on at least one side parallel to groove 64, and substantially flat surfaces on at least one side parallel to the round surface and one side perpendicular to the round surface, in a length-wise direction of the separator 60. The rounded and straight edges or surfaces are provided at terminal portions of the extending portions 68. Two additional extending portions (on a second side of apertures 62) are defined by circulator projections extending in the vertical and horizontal directions from a body of separator 60.

The separator 60 includes a projection 66 projecting from a position between the apertures 62, e.g., from a midpoint in the lengthwise direction of the separator 60. In some embodiments, the projection 66 may be formed in a pyramid shape, or an inverted V or U shape. A terminal end of projection 66 may be aligned with groove 64 in a height-wise direction, or may project beyond the groove 64. The separators 60 additionally have the effect of increasing the spacing between the cassettes so that there will be less "skin effect" on current flow and the current will flow more evenly across all the contact cassettes in a phase. Skin effects arise from the electromagnetic force (EMF) of electrical currents flowing in closely spaced parallel conductors (such as in the multiple conductors and contact cassettes in each phase of an ATS switch). The EMF generally forces the current flows to be uneven, such that in some cases, current which flows out to the conductors at the ends can be double that of the cassettes and bus conductors in the middle of the phase. This can overload the end cassettes electrically or overheat them (the moving and non-moving contacts in the cassette often present the largest electrical resistance and heating source in an ATS), and have the effect of reducing the rated capacity of the ATS prematurely or forcing a heat derating. Inclusion of separators 60 according to exemplary embodiments herein increases the cassette/parallel current flow separation and has the effect of reducing skin effect EMF forces, evening out the current flows and cassette heating effects across the phase, as well as increasing the cooling air flow.

Figure 6:
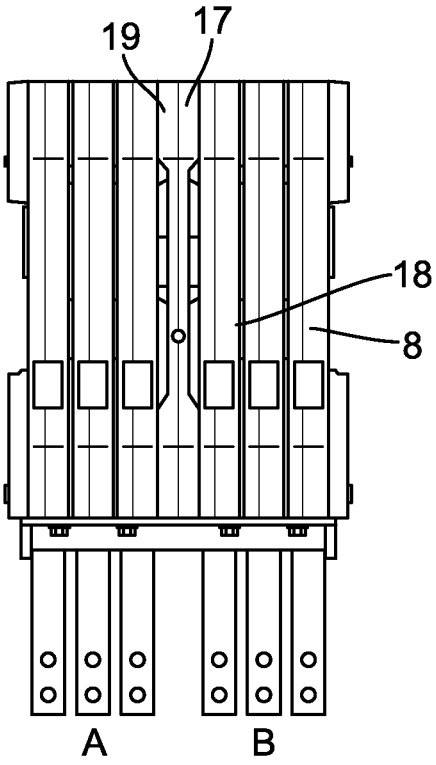
FIG. 6 illustrates another cassette subsystem according to an embodiment.

FIG. 6 depicts a modification of cassette subsystem 40. As with the cassette subsystem 40 shown in FIG. 4, one or more separators 60 may be arranged between the cassettes 8 of a portion of a cassette subsystem 40. In the embodiment shown in FIG. 6, only first and second phases (i.e., phases A and B (elements 2, 4)) are shown. As seen in FIG. 6, two shielding members 17, 19 are provided between phase A 2 and phase B 4. The shielding members 17, 19 are positioned so as to be adjacent and in a parallel orientation to each other. Each shielding member 17, 19 is preferably formed of one or more sheets of laminated electric steel, such as the silicon iron alloys described above, or are stamped, cast, extruded, or machined parts of pure iron. As is shown in FIG. 6, the shielding members 17 and 19 are adjacent to each other, however, they have been formed to a three dimensional shape to increase the physical separation distance between phase 2 and phase 4 (phase A and phase B, respectively). This three dimensional shape further enhances air flow between the phases and the adjacent contact cassettes. It is noted that the shielding members 17, 19 can also be further shaped to form one or more air passages or spaces between the shielding members 17, 19.

The cassette subsystem 40 may be provided in each of the phases 2 and 4. Furthermore, between adjacent cassettes of the cassette subsystem 40, an air gap 18 is present. The air gap 18 may vary in width, and one pair of adjacent cassettes may have a different air gap width than another pair of adjacent cassettes 8. In some embodiments, the air gap 18 may be 1-5 mm in width, in particular, approximately 3 mm or less. While air gaps that are 3 mm achieve effective cooling, wider air gaps may further enhance cooling; however, the overall dimensions of the cassette subsystem 40 will increase by using wider gaps. The shape and configuration of the air gap may be dictated by the shape of the separators 60 and/or the cassettes 8. In the embodiment shown in FIG. 6, the air gap 18 is formed as a narrow slit, for example.

In some embodiments, the cassette subsystem 40 may include both separators 60 and air gap 18 between adjacent cassettes 8. In such embodiments, the air gap 18 and separator 60 may contribute to substantial reductions in temperature, of 5-10° C. or even more than 10° C. as compared to an ATS without one or more of the air gaps 18 and without one or more separators 60. Furthermore, in some embodiments, the air gap 18 may be combined with or replaced by a separate fan (not shown), to achieve further reductions in temperature by forcing air through the system.

In at least one embodiment, a method is provided as may be implemented for assembling and/or manufacturing an ATS system or components thereof, for example. The method includes disposing a first phase switch component, a second phase switch component and a third phase switch component in order of the first phase switch component, the second phase switch component, and the third phase switch component in a linear arrangement, increasing a distance between the first phase switch component and the second phase switch component by placing a first shield between the first phase switch component and the second phase switch component, and increasing a distance between the second phase switch component and the third phase switch component by placing a second shield between the second phase switch component and the third phase switch component, wherein a first actuator is disposed between the first phase switch component and the second phase switch component, and a second actuator is disposed between the second phase switch component and the third phase switch component.

A further embodiment relates to a method comprising disposing a first phase switch component, a second phase switch component and a third phase switch component in order of the first phase switch component, the second phase switch component, and the third phase switch component in a linear arrangement, increasing a distance between the first phase switch component and the second phase switch component by placing a first shield between the first phase switch component and the second phase switch component, and increasing a distance between the second phase switch component and the third phase switch component by placing a second shield between the second phase switch component and the third phase switch component, wherein a first actuator is disposed between the first phase switch component and the second phase switch component, and a second actuator is disposed between the second phase switch component and the third phase switch component.

In addition, in at least one embodiment, the method includes arranging the first shield as a wall of the first actuator, and arranging the second shield as a wall of the second actuator, and each of the first and second shields comprises laminated steel, as described above. The method may further include increasing electromagnetic shielding between the first phase switch component and the second phase switch component by providing the first shield and a third shield, and disposing the first shield on a first side of the first actuator, and disposing the third shield on a second side of the actuator such that the first shield and the third shield form walls of the first actuator. In at least one embodiment, the method includes increasing a flow of air along the first phase switch component and the second phase switch component by placing at least one separator between the first phase switch component and the second phase switch component and directing the flow of air through an opening of the at least one separator. Further, in at least one embodiment, the method includes replacing a wall of the first actuator with the first shield.

While this specification contains specific implementation details, these should not be construed as limitations on the scope of any inventions or of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations may be depicted in a particular order, this should not be understood as requiring that such operations be performed in the particular order shown or in sequential order, or that all operations be performed, to achieve desirable results. Moreover, the separation of various aspects of the implementations described above should not be understood as requiring such separation in all implementations, and it should be understood that the described methods can generally be integrated in a single application or integrated across multiple applications.

The construction and arrangements of the ATS systems as shown in the various exemplary embodiments, are illustrative only. Although only certain embodiments have been described in detail in this disclosure, many modifications are possible (e.g., variations in sizes, dimensions, structures, shapes and proportions of the various elements, values of parameters, mounting arrangements, use of materials, colors, orientations, algorithms, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

As may be utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

References herein to the positions of elements (e.g., "side-by-side," etc.) are merely used to describe the orientation of various elements in the drawings. It should be noted that the orientation of various elements may differ according to other exemplary embodiments, and that such variations are intended to be encompassed by the present disclosure.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

What is claimed is:

1. An automatic transfer switch assembly, comprising:

a first phase switch component, a second phase switch component and a third phase switch component arranged in order of the first phase switch component, the second phase switch component, and the third phase switch component in a line, a first shield disposed between the first phase switch component and the second phase switch component, and a second shield disposed between the second phase switch component and the third phase switch component, wherein each of the first shield and the second shield comprises a plurality of laminations of electrical steel.

2. The automatic transfer switch assembly of claim 1, further comprising:

a first actuator between the first phase switch component and the second phase switch component, and a second actuator between the second phase switch component and the third phase switch component.

3. The automatic transfer switch assembly of claim 1, wherein each of the phases comprises a plurality of contact cassettes.

4. The automatic transfer switch assembly of claim 3, wherein the cassettes are substantially coplanar and parallel to each other.

5. The automatic transfer switch of claim 3, wherein a width of the first shield is less than a width of a contact cassette.

6. The automatic transfer switch of claim 1, wherein the laminations comprise iron or steel alloy having a carbon content of less than 12%.

7. The automatic transfer switch of claim 1, wherein the first shield is parallel to the second shield.

8. An automatic transfer switch comprising:

a first phase switch component comprising a first plurality of cassettes, a second phase switch component comprising a second plurality of cassettes;

a third phase switch component comprising a third plurality of cassettes; and a plurality of separators separating respective cassettes of the pluralities of cassettes, at least one separator of the plurality of separators comprising an air flow path permitting air flow between two neighboring cassettes, a first shield disposed between the first phase switch component and the second phase switch component, and a second shield disposed between the second phase switch component and the third phase switch component, wherein each of the first shield and the second shield comprises a plurality of laminations of electrical steel.

9. The automatic transfer switch of claim 8, wherein:

the at least one separator comprises a plurality of apertures.

10. The automatic transfer switch of claim 8, wherein the at least one separator comprises an inlet positioned between distal ends of the at least one separator, the inlet being defined by the distal ends of the separator and a rib projecting from a median portion of the separator.

11. The automatic transfer switch of claim 8, wherein the at least one separator comprises a notch through which the air flows between the two neighboring cassettes.

12. The automatic transfer switch of claim 8, wherein the air flow path is between end portions of the at least one separator.

13. The automatic transfer switch of claim 8, wherein the at least one separator comprises side members each having a groove therein.

14. The automatic transfer switch of claim 13, wherein at least one groove is substantially rectilinear and offset from a center of one of the side members.

15. A separator assembly, comprising at least one separator, comprising:

a planar portion having at least one notch portion on a surface thereof;

a plurality of adjacent apertures; and two extensions projecting from opposed sides of the planar portion, wherein each of the extensions has a first terminal portion projecting outwardly from the planar portion, and a second terminal portion opposed to the first terminal portion, the second terminal portion being coextensive with at least a portion of the at least one notch portion, and wherein the at least one notch is centered between the extension portions.

16. The separator assembly of claim 15, further comprising a projection having a terminal end that is aligned with the at least one notch portion in a height-wise direction of the at least one notch portion.

17. The separator assembly of claim 16, wherein the projection is formed in an inverted V-shape.

18. The separator assembly of claim 15, wherein the first terminal portion of each extension includes a convex surface.

19. The separator assembly of claim 15, comprising a plurality of separators positioned parallel to each other.

20. The separator assembly of claim 19, wherein:

the separators comprise a first separator and a second separator positioned in parallel with each other, and the first and second separators are positioned to permit air to flow through the apertures and the at least one notch portion of the first separator to the second separator.

21. A method, comprising:

disposing a first phase switch component, a second phase switch component and a third phase switch component in order of the first phase switch component, the second phase switch component, and the third phase switch component in a linear arrangement, spacing the first phase switch component and the second phase switch component apart by placing a first shield between the first phase switch component and the second phase switch component, spacing the second phase switch component and the third phase switch component apart by placing a second shield between the second phase switch component and the third phase switch component, disposing a first actuator between the first phase switch component and the second phase switch component and a second actuator between the second phase switch component and the third phase switch component, and arranging the first shield as a wall of the first actuator, and arranging the second shield as a wall of the second actuator, wherein each of the first and second shields comprises laminated steel.

22. The method of claim 21, further comprising:

increasing electromagnetic shielding between the first phase switch component and the second phase switch component by providing the first shield and a third shield, and disposing the first shield on a first side of the first actuator, and disposing the third shield on a second side of the actuator such that the first shield and the third shield form walls of the first actuator.

23. The method of claim 21, further comprising:

increasing a flow of air along the first phase switch component and the second phase switch component by placing at least one separator between the first phase switch component and the second phase switch component and directing the flow of air through an opening of the at least one separator.

24. The method of claim 23, further comprising replacing a wall of a case of the first actuator with the first shield.

* * * * *